US005530536A

United States Patent [19]

Henry et al.

[11] Patent Number: 5,530,536

[45] Date of Patent: Jun. 25, 1996

[54] LOW MODULUS FUSER MEMBER

[75] Inventors: Arnold W. Henry, Pittsford; George J. Heeks, Rochester; Clifford O. Eddy, Webster; Louis D. Fratangelo, Fairport, all of N.Y.

[73] Assignee: Xerox Corporation, Stamford, Conn.

[21] Appl. No.: 164,851

[22] Filed: Dec. 10, 1993

[51] Int. Cl.[6] ..... G03G 15/20

[52] U.S. Cl. ..... 355/295; 219/216

[58] Field of Search ..... 355/284, 282, 355/285, 290, 295; 219/216, 469–471; 428/423.1, 423.5, 447

[56] References Cited

U.S. PATENT DOCUMENTS

| | | | |
|---|---|---|---|
| 3,912,901 | 10/1975 | Strella et al. | 219/216 |
| 4,029,827 | 6/1977 | Imperial et al. | 430/48 |
| 4,101,686 | 7/1978 | Strella et al. | 430/120 |
| 4,185,140 | 1/1980 | Strella et al. | 219/216 |
| 4,257,699 | 3/1981 | Lentz | 355/284 |
| 4,264,181 | 4/1981 | Lentz et al. | 355/284 |
| 4,272,179 | 6/1981 | Seanor | 355/289 |
| 5,017,432 | 5/1991 | Eddy et al. | 428/422 |
| 5,061,965 | 10/1991 | Ferguson et al. | 355/284 |
| 5,330,840 | 7/1994 | Chen et al. | 428/423.1 |
| 5,379,099 | 1/1995 | Senba et al. | 355/284 |

*Primary Examiner*—Arthur T. Grimley
*Assistant Examiner*—Shuk Y. Lee
*Attorney, Agent, or Firm*—Samuel Mott; Zosan Soong; Annette L. Bade

[57] ABSTRACT

A soft sleeveless long wearing pressure roll member having a cylindrical core, wherein the pressure roll has thereon, a nonswelling in silicone oil, layer of a thermally stable hydrofluoroelastomer having a Young's modulus of elasticity less than 500 lbs./in.$^2$, from about 250 mils. to about 500 mils. in thickness and a hardness of from about 45 to about 60 Shore A is provided.

16 Claims, 2 Drawing Sheets

LOW MODULUS FUSER MEMBER

BACKGROUND OF THE INVENTION

The present invention relates to a fuser member and a fusing system for fusing toner images in electrostatographic printing apparatus. In particular, it relates to a long-life fuser member and more specifically to a back up pressure roll in a fusing system which includes a fuser roll and a pressure roll.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or another support sheet such as plain paper.

The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, thermoplastic resin particles are fused to the substrate by heating to a temperature of between about 90° C. to about 160° C. or higher depending upon the softening range of the particular resin used in the toner. It is not desirable, however, to raise the temperature of the substrate substantially higher than about 200° C. because of the tendency of the substrate to discolor at such elevated temperatures particularly when the substrate is paper.

Several approaches to thermal fusing of electroscopic toner images have been described in the prior art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles is well known in the art, and they can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip effects the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus, increasing the background or interfering with the material being copied there. The so called "hot offset" occurs when the temperature of the toner is raised to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface which has a low surface energy to provide the necessary release. To insure and maintain good release properties of the fuser roll, it has become customary to apply release agents to the fuser members to insure that the toner is completely released from the fuser roll during the fusing operation. Typically, these materials are applied as thin films of, for example, silicone oils to prevent toner offset.

PRIOR ART

Some recent developments in fuser members, release agents and fusing systems are described in U.S. Pat. No. 4,264,181 to Lentz et al., U.S. Pat. No. 4,257,699 to Lentz and U.S. Pat. No. 4,272,179 to Seanor, all commonly assigned to the assignee of the present application. These patents describe fuser members and methods of fusing thermoplastic resin toner images to a substrate wherein a polymeric release agent having functional groups is applied to the surface of the fuser member. The fuser member comprises a base member having an elastomeric surface with a metal containing filler therein which has been cured with a nucleophilic addition curing agent. Exemplary of such fuser member is an aluminum base member with a poly(vinylidenefluoride-hexafluoropropylene) copolymer cured with bisphenol curing agent having lead oxide filler dispersed therein and utilizing a mercapto functional polyorganosiloxane oil as a release agent. In those fusing processes, the polymeric release agents have functional groups (also designated as chemically reactive functional groups) which interact with the metal containing filler dispersed in the elastomer or resinous material of the fuser member surface to form a thermally stable film which releases thermoplastic resin toner and which prevents the thermoplastic resin toner from contacting the elastomer material itself. The metal oxide, metal salt, metal alloy or other suitable metal compound filler dispersed in the elastomer or resin upon the fuser member surface interacts with the functional groups of the polymeric release agent. Preferably, the metal containing filler materials do not cause degradation of or have any adverse effect upon the polymeric release agent having functional groups. Because of this reaction between the elastomer having a metal containing filler and the polymeric release agent having functional groups, excellent release and the production of high quality copies are obtained even at high rates of speed of electrostatographic reproducing machines.

While the mechanism involved is not completely understood it has been observed that when certain polymeric fluids having functional groups are applied to the surface of a fusing member having an elastomer surface with a metal oxide, metal salt, metal, metal alloy or other suitable metal compounds dispersed therein there is an interaction (a chemical reaction, coordination complex, hydrogen bonding or other mechanism) between the metal of the filler in the elastomer and the polymeric fluid having functional groups so that the polymeric release agent having functional groups in the form of a liquid or fluid provides an excellent surface for release, having an excellent propensity to remain upon the surface of the fuser member. Regardless of the mechanism, there appears to be the formation of a film upon the elastomer surface which differs from the composition of the elastomer and the composition of the polymeric release agent having functional groups. This film, however, has a greater affinity of the elastomer containing a metal compound than the toner and thereby provides an excellent release coating upon the elastomer surface. The release coating has a cohesive force which is less than the adhesive forces between heated toner and the substrate to which it is applied and the cohesive forces of the toner. The interaction between the functional group of the polymeric release agent and the metal of the elastomer containing metal leads to an overall diminution of the critical or high surface energy of the metal in the metal containing filler.

The preferred elastomers are the fluoroelastomers and the most preferred fluoroelastomers are the vinylidenefluoride based fluoroelastomers which contain hexafluoropropylene and tetrafluoroethylene as comonomers. Two of the most preferred fluoroelastomers are (1) a class of copolymers of vinylidenefluoride and hexafluoropropylene known commercially as Viton A (2) a class of terpolymers of vinylidenefluoride, hexafluoropropylene and tetrafluoroethylene known commercially as Viton B. Viton A and Viton B and other Viton designations are trademarks of E. I. DuPont deNemours and Company. Other commercially available materials include Fluorel of 3M Company, Viton GH, Viton E 60C, Viton B 910, and Viton E 430. The preferred curing system is a nucleophilic system with a bisphenol crosslinking agent to generate a covalently crosslinked network polymer formed by the application of heat following basic dehydrofluorination of the copolymer. The nucleophilic curing system also includes an organophosphonium salt accelerator. Some of the commercially available fluoroelastomer polymers which can be cured with the nucleophilic system include Viton E 60C, Viton B 910, Viton E 430, Viton A and Viton B, while similar fuser rolls may be cured with a conventional aliphatic peroxide curing agent.

The use of polymeric release agents having functional groups which interact with a fuser member to form a thermally stable, renewable self-cleaning layer having superior release properties for electroscopic thermoplastic resin toners is described in U.S. Pat. Nos. 4,029,827 to Imperial et al., 4,101,686 to Strella et al. and 4,185,140 also to Strella et al., all commonly assigned to the assignee of the present invention. In particular, U.S. Pat. No. 4,029,827 is directed to the use of polyorganosiloxanes having mercapto functionality as release agents. U.S. Pat. Nos. 4,101,686 and 4,185,140 are directed to polymeric release agents having functional groups such as carboxy, hydroxy, epoxy, amino, isocyanate, thioether, and mercapto groups as release fluids. Some of these fusing systems have enjoyed significant commercial application. For example, a fuser roll made from Viton E 45 (a copolymer of 77 weight percent vinylidenefluoride and 23 weight percent hexafluoropropylene) filled with lead oxide has been successfully used in a fusing system employing a mercapto functional polyorganosiloxane release agent.

U.S. Pat. No. 3,912,901 to Strella et al. describes a sleeved pressure roll useful in fusing systems in electrostatographic printing apparatus which comprises an outer sleeve of a copolymer of perfluoroalkyl perfluorovinyl ether with tetrafluoroethylene (PFA), a rigid inner core and a layer of resilient material between the inner core and the outer sleeve. In fabricating this roll, typically the resilient material, which is of an EPDM rubber, is bonded to both the inner rigid core on one side and the outer sleeve on the other side. In addition to the PFA described in Strella et al., other materials such as fluorinated ethylene propylene and polytetrafluoroethylene have been employed to form the thin sleeve on such a pressure roll. While these rolls are capable of performing satisfactorily in many applications they do exhibit certain deficiencies, particularly when used in high speed, high output machine environments. In addition to several failure modes that may be associated with such a roll other difficulties are also present. For example, a soft failure may be experienced by the formation of a groove in the surface of the pressure roll. This typically happens when one is running 11 in. paper, which is edge registered so that heat and temperature build up in the 11 in. to 14 in. region of the roll, leading to the formation of a groove being formed in the 11 in. to 14 in. region of the PFA roll which develops rather quickly to a dimension of 1 mil. to 3 mils. after 1,500,000 copies. This soft failure mode of course is only observed when both 11 in. and 14 in. paper are being used in the machine. In addition, the hard sleeve of the pressure roll may lead to an increase in the paper edge wear of the fuser roll, since as the paper is pressed against the roll the stress is higher and over time the increased wear at the paper edge, particularly the 11 in. section, can actually be seen and felt giving rise to a poor toner fix in this area on wider prints. The worst failure mode, however, has to do with a hard failure mode wherein the layer of resilient material such as the EPDM intermediate layer ruptures or is debonded from either the rigid core or the outer sleeve, or both. This is due to the triaxial stresses of the resilient layer being pulled in the XYZ directions, since it is so tightly bonded to the two surfaces, i.e. the core and outer sleeve. As a result, any small flaws in the layer can rupture when the stress gets to a certain level, which can subsequently lead to rapid enlargement of small flaws causing roll rupture and fusing failure. At rupture of the EPDM resilient layer an unpleasant odor from the acetophenone derives from the dicumyl peroxide used in the cure of the EPDM is experienced. In addition, once the rubber has failed, in this hard mode, the debris, from the rubber, is transported throughout the machine, causing occasional damage to other machine components and typically requiring a trained service man to clean and/or repair the machine, resulting in machine down time and customer dissatisfaction.

SUMMARY OF INVENTION

According to the present invention a low modulus sleeveless pressure roll for the fuser system in an electrostatographic printing machine has the advantages of providing longer life for both the pressure roll and it's companion fuser roll. By eliminating the triaxial stresses that are set up when a rubber is bonded to both a core and a rigid outer sleeve such as with PFA, the problem of catastrophic fracture of the rubber is avoided. This objective is achieved with the consideration of several factors, namely, the softness of the roll material, since it is desired to keep it as soft as possible to enable as thin a layer as possible and thereby minimize material cost, while at the same time insuring that the layer is sufficiently thick to minimize the strain energy imposed per cycle as the roll goes through the deformation cycle in the fusing nip to achieve a reasonable roll life. Strain energy is a characteristic which is cumulative and therefore in high speed, high volume machines, the layer must be thick enough to withstand the deformation cycle through several hundred thousand if not millions of cycles.

According to a principle aspect of the present invention a soft, sleeveless, long wearing fuser member, comprising a cylindrical core, a nonoxidizing, nonswelling in silicone oil, layer of a thermally stable FKM hydrofluoroelastomer having a Young's modulus of elasticity less than 500 lbs. per in.$^2$, from about 250 mils. to about 500 mils. in thickness and a hardness of from about 45 to about 60 Shore A is provided.

In a further aspect of the present invention the hardness of the layer is nominally about 55 Shore A.

In a further aspect of the present invention the layer is thermally stable over 350° F. and preferably up to about 450° F.

In a further aspect of the present invention the layer is an FKM hydrofluoroelastomer and is preferably about 400 mils. in thickness.

In a further aspect of the present invention the modulus of elasticity is from about 250 lbs. per in.$^2$ to about 500 lbs. per in.$^2$, and there is a thin adhesive layer between the core and the FKM layer.

In a further aspect of the present invention the fuser member is used as a backup pressure roll in a fusing system comprising a fuser roll and a pressure roll and the strain energy imposed per cycle on the pressure roll is less than 5 in.-lbs. per in.$^3$.

DETAILED DESCRIPTION OF THE PRESENT INVENTION

Figure 1:
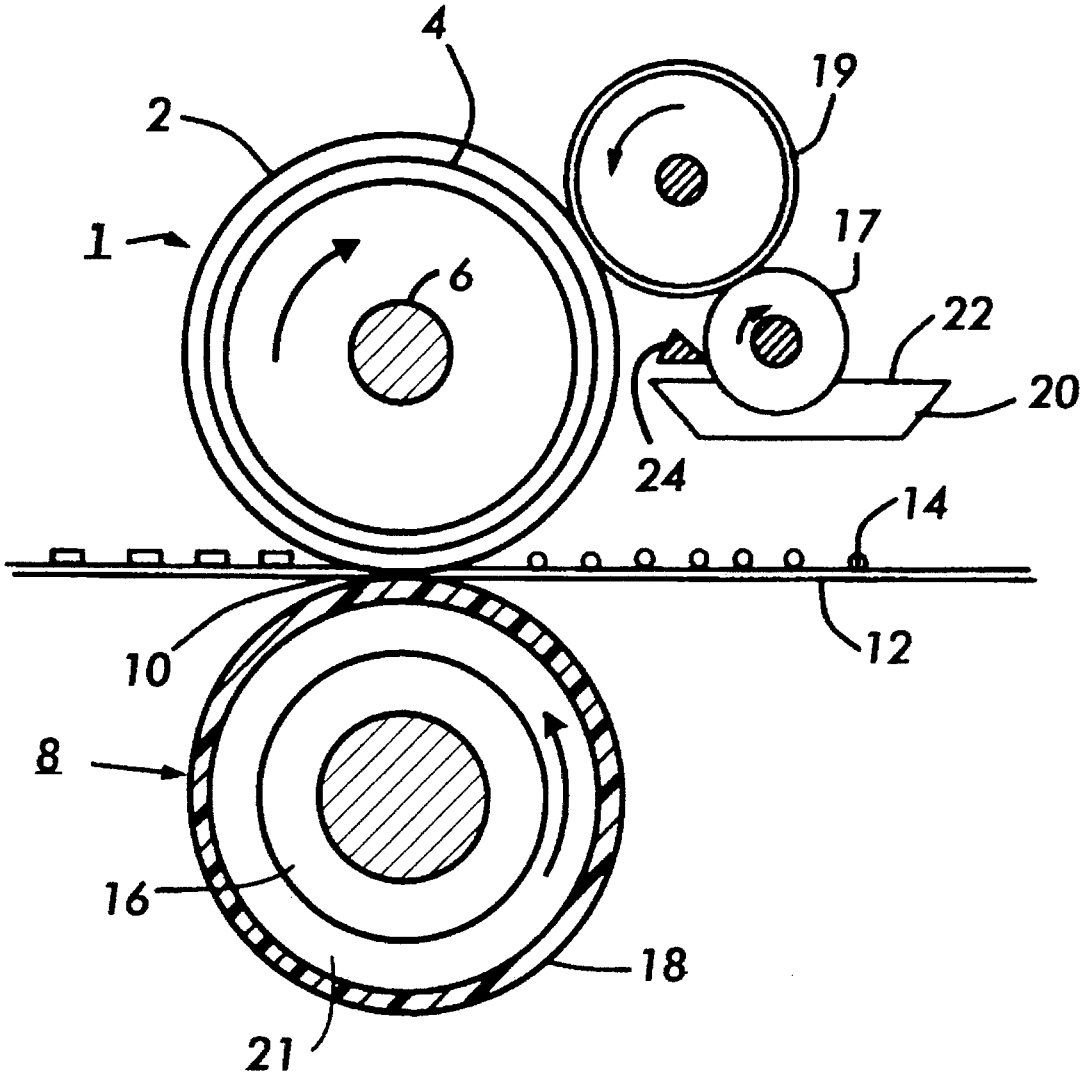
FIG. 1 is a sectional view of a fuser system which may use the fuser meter according to the present invention.

A typical fuser member of the present invention is described in conjunction with a fuser assembly as shown in FIG. 1 where the numeral 1 designates a fuser roll comprising elastomer surface 2 upon suitable base member 4 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a nip or contact arc 10 through which a copy paper or other substrate 12 passes such that toner images 14 thereon contact elastomer surface 2 of fuser roll 1. As shown in FIG. 1, the backup roll 8 has a rigid hollow steel core 16 with a soft surface layer 18 thereon. Optionally, an adhesive layer 21 may be provided between the core 16 and soft surface layer 18. Sump 20 contains polymeric release agent 22 which may be a solid or liquid at room temperature, but is a fluid at operating temperatures.

In the embodiment shown in FIG. 1 for applying the polymeric release agent 22 to elastomer surface 2, two release agent delivery rolls 17 and 19 rotatably mounted in the direction indicated are provided to transport release agent 22 from the sump 20 to the elastomer surface. As illustrated in FIG. 1, roll 17 is partly immersed in the sump 20 and transports on its surface release agent from the sump to the delivery roll 19. By using a metering blade 24 a layer of polymeric release fluid can be applied initially to the delivery roll 19 and subsequently to elastomer 2 in controlled thickness ranging from submicrometer thickness to thickness of several micrometers of release fluid. Thus, by metering device 24 about 0.1 to 2 micrometers or greater thickness of release fluid can be applied to the surface of elastomer 2.

As used herein, the term fuser member may be a roll, belt, flat surface or other suitable shape used in the fixing of thermoplastic toner images to a suitable substrate. It may take the form of a fuser member, a pressure member or a release agent donor member preferably in the form of a cylindrical roll. Typically, the fuser member is made of a hollow cylindrical metal core, such as copper, aluminum, steel and like, and has an outer layer of the selected cured fluoroelastomer. Alternatively, there may be one or more intermediate layers between the substrate and the outer layer of the cured elastomer if desired. Typical materials having the appropriate thermal and mechanical properties for such layers include silicone elastomers, fluoroelastomers, EPDM and Teflon PFA sleeved rollers.

The FKM hydrofluoroelastomers, according to the present invention, are those defined in ASTM designation D1418-90 and are directed to fluororubbers of the polymethylene type having substituent fluoro and perfluoroalkyl or perfluoroalkoxy groups on a polymer chain.

The fluoroelastomers useful in the practice of the present invention are those described in detail in the above referenced U.S. Pat. No. 4,257,699 to Lentz, as well as those described in commonly assigned U.S. Pat. Nos. 5,017,432 to Eddy et al. and 5,061,965 to Finsterwalder et al. As described therein, these fluoroelastomers, particularly from the class of copolymers and terpolymers of vinylidenefluoride hexafluoropropylene and tetrafluoroethylene, known commercially under various designations as Viton A, Viton E60C, Viton E430, Viton 910, Viton GH and Viton GF. The Viton designation is a Trademark of E. I. DuPont deNemours, Inc. Other commercially available materials include Fluorel 2170, Fluorel 2174, Fluorel 2176, Fluorel 2177 and Fluorel LVS 76, Fluorel being a Trademark of 3M Company. Additional commercially available materials include Aflas a Poly(propylene-tetrafluoroethylene) copolymer, Fluorel II a Poly(propylene-tetrafluoroethyelene-vinylidenefluoride) terpolymer both also available from 3M Company. Also, the Tecnoflons identified as FOR-60KIR, FOR-LHF, NM, FOR-THF, FOR-TFS, TH, TN505 are available from Ausimont Chemical Co. Typically, these fluoroelastomers can be cured with a nucleophilic addition curing system, such as a bisphenol crosslinking agent with an organophosphonium salt accelerator as described in further detail in the above referenced Lentz Patent, and in U.S. Pat. No. 5,017,432 to Eddy et al. or with a peroxide as described in DuPont's literature.

In a particularly preferred embodiment, the fluoroelastomer is about 68 weight percent fluorine such as in various Flurorel grades available from 3M as previously discussed.

Figure 2:
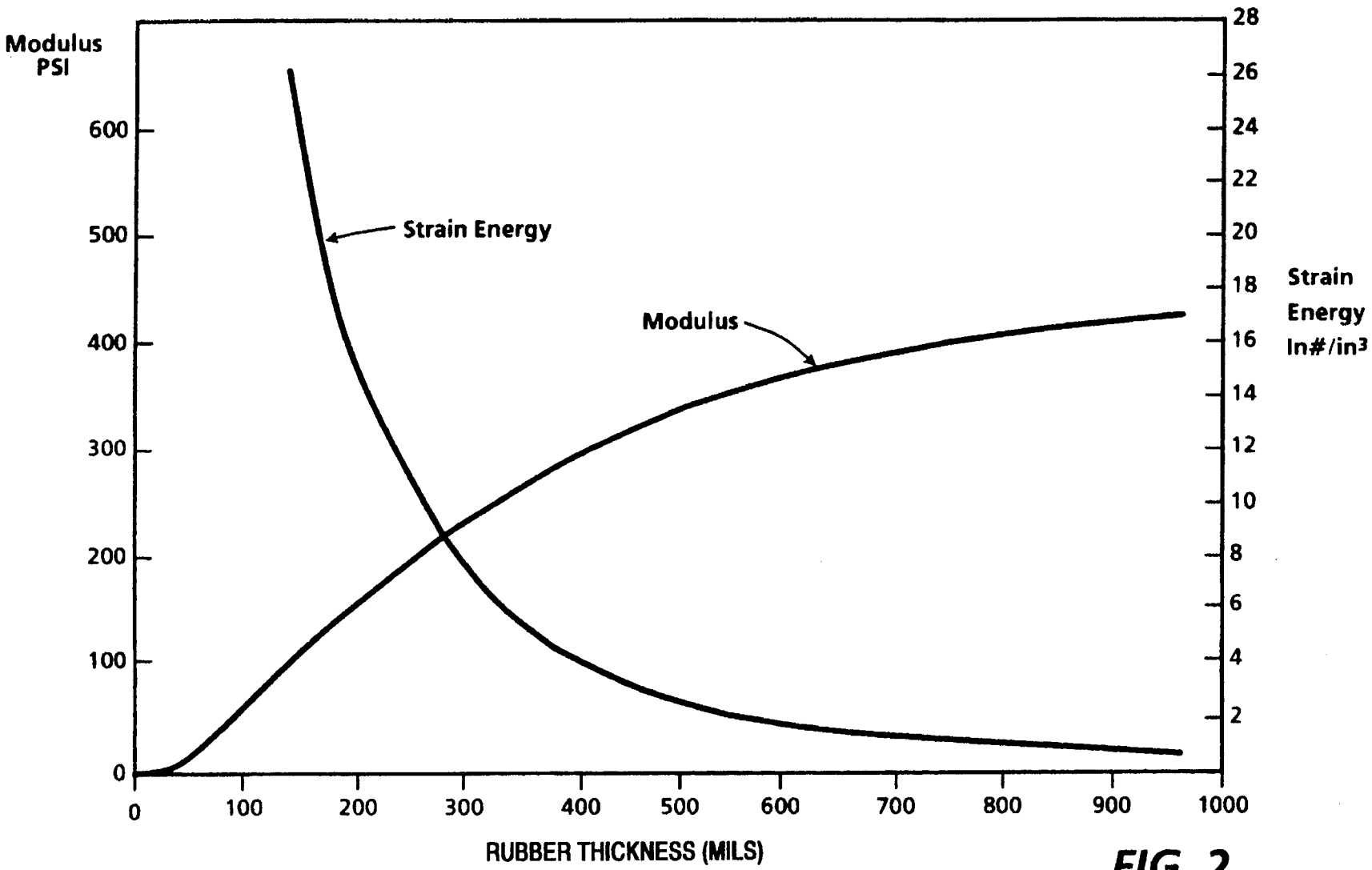
FIG. 2 is a graphical representation of the variation of modulus and strain energy with thickness of the pressure member while maintaining the nip width between the pressure member and the fuser member constant.

By the term thermally stable it is intended to define hydrofluoroelastomers which are able to maintain their elasticity for many hundreds of thousands if not millions of copies at elevated temperatures of the order of 350° F. and up to 450° F. By the term Young's modulus of elasticity it is intended to define an elastic modulus where there is a coefficient of elasticity representing the ratio of stress to strain as a material is deformed under a tensile load. It is a measure of the softness or stiffness of the material and is expressed in pounds per square inch and is represented by the curve in FIG. 2 for various thicknesses of hydrofluoroelastomer while maintaining a constant fusing nip width. Young's modulus of elasticity for the materials useful in the present invention is less than about 500 lbs. per in.$^2$ and preferably from about 250 to about 500 and most preferably is 400 lbs. per in.$^2$. Since strain energy is defined as the amount of energy a cubic volume of elastomer is subjected to during an imposed deformation such as the rubber experiences as it moves through the fusing nip and is cumulative building up over time it is desired to keep the level of strain energy imposed per cycle below about 5 in.-lbs./in.$^3$. Hardness is the resistance of a material to deformation by an indenter of specific size and shape under a known load and typically for elastomers is expressed as durometer hardness and in the present example is typically within the range of 45 to 60 Shore A and preferably is 55 Shore A because this enables the use of a moderate thickness of elastomer on the pressure roll without introducing strain energy levels significantly greater than 5 in.-lbs./in.$^3$. As may be observed from the strain energy curve in FIG. 2, the strain energy induced in the elastomer per cycle increases with reduction in thickness. Accordingly, it is desired to have the hydrofluoroelastomer be as thin as possible for cost without greatly exceeding strain energy guidelines. In addition, the hydrofluoroelastomers useful in the practice of the present invention are non-oxidizing being thermally stable to both heat and to oxygen and should not swell when contacted by a silicone oil release agent. In this regard it may be desirable to include a small amount from about 5 of about 25 parts per hundred parts by weight of the hydrofluoroelastomer of a metal oxide such as, for example, cupric oxide to function as an anchoring site for a functional release agent that may be used in the fusing system it being noted that no metal oxide is required for certain release agents.

Other adjuvents and fillers may be incorporated in the elastomer in accordance with the present invention as long as they do not effect the integrity of the elastomer, the interaction between the metal oxide and the polymeric release agent having functional groups, or prevent the appropriate crosslinking of the elastomer. Such fillers normally encountered in the compounding of elastomers include coloring agents, reinforcing fillers, crosslinking agents, processing aids, accelerators and polymerization initiators.

In some instances it may be desirable to provide high temperature plasticizers to the hydrofluoroelastomer as a way of reducing the internal viscosity thereby providing a material of low durometer hardness that can be used as a very thin layer. Such a hydrofluoroelastomer would be Tecnoflon FOR LHF available from Ausimont of Morristown, N.J.

The pressure roll, according to the present invention, is typically made with any suitable substrate such as a carbon steel about 2.2 inches outside diameter, which is hollow, has been degreased, sandblasted and degreased once again. An adhesive such as Thixon 300/311, an epoxy adhesive, is applied to the substrate by dipping or preferably by spraying to a thickness of about 0.6 mils. Thixon is a trademark of Morton Corporation. All the solids that are going into the hydrofluoroelastomer layer are placed in a mixture such as an internal mixer like a Banbury mixer, or, on a two roll mil. where the rubber is first added and then the other ingredients are incorporated. If all the solids are initially mixed in a Banbury mixer they are then further mixed in a two roll mil. and slabs of the totally mixed ingredients are sheeted off the rail. The sheeted off or cut sheet material may be applied to the adhesive coated core in several different techniques. Typically, the sheets are applied to the core to provide a thickness of the hydrofluoroelastomer of from about 250 mils. to 500 mils. in thickness and preferably a layer greater or equal to 400 mils. in thickness. It may, for example, be cut into two pieces, providing a top and a bottom and placed in a compression mode. Alternatively, strips may be fed into a ram extruder which blends it, heats it and rams it into a mold. Pressure rolls, prepared according to the compression molding technique discussed above, are subjected to a cure at 350° F. for 25 minutes and removed from the mold. Pressure rolls prepared according to the ram extruder procedure are placed in an oven for 9 hours at 280° F. and removed from the mold. Rolls made according to both procedures were then subjected to a postcure by step wise heating in air at 95° C. for 2 hours followed by 150° C. for 2 hours, 175° C. for 2 hours, 205° C. for 2 hours and 230° C. for 16 hours.

The following examples further define and describe the pressure rolls prepared according to the present invention and illustrate preferred embodiment of the present invention. Unless otherwise indicated all parts and percentages are by weight. In the Examples, Example I is according to the present invention and Example II is presented for comparative purposes.

EXAMPLE I

A pressure roll was prepared according to the above general procedure with the following formulation to provide a reduced crosslink density elastomer.

Fluorel FC 2123, 50 parts by weight

Fluorel FC 2145, 50 parts by weight

Dynamar FX 5166, 0.1 parts by weight

Maglite D, 3.0 parts by weight

Ca ($OH_2$), 3 parts by weight

CaO, 5 parts by weight

CuO 15 parts by weight

The Fluorel FC 2123 and FC 2145 are both copolymers of vinylidienefluoride-hexafluoropropylene with the 2123 including a crosslinking agent and the 2145 not including a crosslinking agent. By using this combination, a lower crosslinked density and thereby softer and lower modulus cured elastomer is provided. The Dynamar FX 5166 is a cure accelerator which is a phosphonium salt and is available from 3M. The Maglite D and calcium hydroxide all act to dehydrofluorinate the copolymers to provide rapid vulcanization. In addition, the calcium oxide combines with water generated during the cure and by so doing prevents fissuring of the cured hydrofluoroelastomer. The cupric oxide is added to provide anchoring sites for mercapto functional oil release agents used in the fusing system. The fuser roll was used in a fusing system as illustrated in FIG. 1 which included a fuser roll made according to the procedure outlined in U.S. Pat. No. 5,017,432, Example III and a donor roll described in U.S. Pat. No. 5,166,031, Example III.

EXAMPLE II

A pressure roll was prepared according to the procedure outlined in U.S. Pat. No. 3,912,901.

Both rolls were evaluated in a Xerox 5090 duplicator and after 1.5 million prints had been made, the sleeveless pressure roll according to Example I showed a level of paper edge wear about one-fifth of that exhibited by the grooving of the sleeved pressure roll after the same number of copies. Furthermore, the wear of the companion fuser roll running with the unsleeved pressure roll after 1.5 million prints, also shows one fifth the edge wear than a comparable fuser roll run with the sleeved pressure roll. This is believed to be due to the fact that the compliant surface of the low durometer unsleeved pressure roll does not force the paper edge into the conformable fuser roll coating as much as the hard fluoroplastic sleeve does of the sleeved pressure roll. Accordingly, a longer wear life of the fuser roll is also expected when running against the low durometer unsleeved pressure roll. Further evaluation of the pressure roll made according to Example I has indicated a life expectancy in excess of 2 million prints without failure except for failure from adhesive failure. In addition, the pressure roll made according to the technique of Example I, provides an excellent fix of the toner to the print substrate and allowed a drop of fusing temperature of about 10 degrees in providing an equivalent fix. In addition, there was no degradation in copy quality.

Thus, according to the present invention a long life pressure roll has been provided which is capable of a life extension on pressure and fuser roll life because of the reduced amount of stress on the companion fuser roll, lower edge wear of the pressure roll, minimization of hard failure of the pressure roll, elimination of the triaxial stress condition, provides a lower fix temperature, enables a faster machine, does not swell in the presence of silicone release agent and eliminates the evolvement of noxious gases during hard failure.

All the patents and applications referred to herein are hereby specifically and totally incorporated herein by reference in their entirety in the instant specification.

While the invention has been described in detail with reference to specific and preferred embodiments it will be appreciated that various modifications and variation will be apparent to the artisan. For example while the invention has been described with reference to a pressure roll it will be understood that it can be used in a variety of geometric configurations as well as a fuser roll and a release agent donor roll. Accordingly, all such modifications and embodiments as may readily occur to one skilled in the art are intended to be within the scope of the appended claims.

What is claimed is:

1. A sleeveless, long wearing pressure roll comprising a cylindrical core, said pressure role having thereon a layer including a hydrofluoroelastomer, wherein said layer has a Young's modulus of elasticity less than 500 lbs. per. in.$^2$, a thickness ranging from about 250 mils. to about 500 mils., and a hardness of from about 45 to about 60 Shore A, wherein there is absent an outer sleeve over said layer.

2. The pressure roll of claim 1, wherein the hardness of said layer is nominally about 55 Shore A.

3. The pressure roll of claim 1, wherein said layer is thermally stable above 350° F.

4. The pressure roll of claim 3, wherein said layer is thermally stable above 450° F.

5. The pressure roll of claim 1, wherein said layer is about 400 mils. in thickness.

6. The pressure roll of claim 1, further including a thin adhesive layer between said core and said layer.

7. The pressure roll of claim 1, wherein said modulus of elasticity is from about 250 lbs. per in.$^2$ to about 500 lbs. per in.$^2$.

8. The pressure roll of claim 1, wherein said layer is nonswelling in silicone oil.

9. A fusing system for an electrostatographic printing machine comprising a fuser member and a soft, sleeveless, long wearing pressure roll, said pressure roll comprising a cylindrical core, said pressure roll having thereon a nonswelling in silicone oil layer including a thermally stable hydrofluoroelastomer, wherein the layer has a Young's modulus of elasticity less than 500 lbs. per. in.$^2$, a thickness ranging from about 250 mils. to about 500 mils., and a hardness of from about 45 to about 60 Shore A, wherein there is absent an outer sleeve over said layer.

10. The pressure roll of claim 9, wherein a strain energy imposed per cycle on said pressure roll is less than 5 in.-lbs./in.$^3$.

11. The pressure roll of claim 9, wherein the hardness of said layer is nominally about 55 Shore A.

12. The pressure roll of claim 9, wherein said layer is thermally stable above 350° F.

13. The pressure roll of claim 12, wherein said layer is thermally stable above 450° F.

14. The pressure roll of claim 9, wherein said layer is about 400 mils. in thickness.

15. The pressure roll of claim 9, further including a thin adhesive layer between said core and said layer.

16. The pressure roll of claim 9, wherein said modulus of elasticity is from about 90 lbs. per in.$^2$ to about 500 lbs. per in.$^2$.

* * * * *